US006435917B1

(12) United States Patent
McDonald et al.

(10) Patent No.: US 6,435,917 B1
(45) Date of Patent: Aug. 20, 2002

(54) ELECTRICAL JACK

(75) Inventors: Thomas E. McDonald, Tulsa; James F. Schonefeld, Broken Arrow, both of OK (US)

(73) Assignee: Unicorp Systems, LLC, Tulsa, OK (US)

( * ) Notice: Subject to any disclaimer, the term of this patent is extended or adjusted under 35 U.S.C. 154(b) by 0 days.

(21) Appl. No.: 09/666,034

(22) Filed: Sep. 20, 2000

(51) Int. Cl.[7] ..... H01R 17/18
(52) U.S. Cl. ..... 439/669; 439/206
(58) Field of Search ..... 439/668, 669, 439/205, 206

(56) References Cited

U.S. PATENT DOCUMENTS

| | | | | |
|---|---|---|---|---|
| 1,699,678 | A | 1/1929 | Schellenger | 439/668 |
| 2,504,419 | A | 4/1950 | Howell | 173/357 |
| 3,230,497 | A | 1/1966 | Greasley | 339/176 |
| 3,234,500 | A | 2/1966 | Buckland | 339/182 |
| 3,383,481 | A | 5/1968 | Bailey et al. | 200/51.1 |
| 3,855,568 | A | 12/1974 | Cochrane | 339/95 R |
| 4,130,328 | A | 12/1978 | Wessel | 339/18 C |
| 4,158,472 | A | 6/1979 | Seiden et al. | 339/19 |
| 4,367,907 | A | 1/1983 | Buck | 339/113 R |
| 4,655,535 | A | 4/1987 | Kysiak | 339/182 R |
| 4,695,116 | A | 9/1987 | Bailey et al. | 439/188 |
| 4,705,485 | A | 11/1987 | Hansen | 439/669 |
| 4,846,719 | A | 7/1989 | Iwashita | 439/63 |
| 4,867,708 | A | 9/1989 | Iizuka | 439/668 |
| 5,018,044 | A | 5/1991 | Weiss | 361/220 |
| 5,070,605 | A | 12/1991 | Daglow et al. | 29/842 |
| 5,277,628 | A | 1/1994 | Lin et al. | 439/668 |
| 5,338,215 | A | 8/1994 | Lee et al. | 439/188 |
| 5,823,796 | A | 10/1998 | Bethurum | 439/76.1 |
| 5,934,924 | A * | 8/1999 | Suzuki | 439/668 |

* cited by examiner

*Primary Examiner*—Gary Paumen
*Assistant Examiner*—Felix O. Figueroa
(74) *Attorney, Agent, or Firm*—Head, Johnson & Kachigian

(57) ABSTRACT

An electric jack for receiving an electrical plug having two discrete electrical contact portions and establishing an electrical connection therebetween. The jack comprises in combination a housing having an electrical plug receiving chamber, a plug tip reservoir purposed to contingently receive broken or otherwise separated portions of a previously inserted plug, an access/egress aperture communicating with the chamber for insertion therethrough of the electrical plug, a plurality of compressible, partially cylindrical contacts each having a circuit contact section and an electrical plug contact section and housed within the receiving chamber, with pin contacts positioned generally perpendicular to the base of the jack along opposite sides of the receiving chamber.

21 Claims, 2 Drawing Sheets

ELECTRICAL JACK

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

I. Field of the Invention

This invention relates generally to electrical jacks and more specifically to an electrical jack assembly comprising a plurality of compressible cylindrical contacts which receive and securely position an electrical plug to facilitate an electrical connection between distinct contact portions of the plug and electrical circuitry in communication with said contacts.

II. Prior Art

The use of an electrical jack to receive an electrical plug in order to establish a connection therebetween through a series of contacts is known in the prior art. See U.S. Pat. No. 3,230,497 issued to Greasley on Jan. 18, 1966 which discloses a socket for electrical jack plugs and U.S. Pat. No. 5,277,628 issued to Lin et al. on Jan. 11, 1994 which discloses an auditory jack.

After extended use, the contacts lose their elasticity which renders these contacts ineffective in establishing a connection with an electrical plug. The prior art has attempted to resolve this ongoing problem and any advancement in this regard would be considered an improvement thereof.

An illustration of a typical electrical jack/plug combination as found and practiced in the prior art is provided for reference as FIG. 1.

BRIEF SUMMARY OF THE INVENTION

The following objects and advantages, without limitation, are achieved in the electrical jack of the instant invention which comprises in combination a housing having an electrical plug receiving chamber, a plug tip reservoir purposed to contingently receive broken or otherwise separated portions of a previously inserted plug, an access/egress aperture communicating with the chamber for insertion therethrough of the electrical plug, a plurality of compressible, partially cylindrical contacts each having a circuit contact section and an electrical plug contact section and housed within said chamber, with said pin contacts positioned generally perpendicular to the base of said jack along generally opposite sides of said chamber.

Electrical jack/electrical plug combinations are used in many industries. An illustrative, non-limiting example, the airline industry allows passengers to utilize such combinations in conjunction with headsets to listen to music, as well as audio portions of an in-flight movie, while in personal entertainment systems, such as tranportable radios and cassette players, such jack/electrical plug combinations allow a user the convenience of listening to favorite programs/tapes without disturbing others in close proximity. Jack/plug combinations are also widely used to facilitate electrical communication equipment and musical instrument/amplifier connections.

Repeated use causes contacts within the jack to lose their elasticity which inhibits proper positioning and contact between the jack and the plug. Consequently, in view of the deficiencies of the prior art, it is an objective of the instant invention to provide an improved jack embodying contacts which allow for proper and secure positioning of an inserted plug while not losing their elasticity.

It is yet another object of the instant invention to provide a headphone jack positioning and securing mechanism which avoids the mechanical failures of the prior art.

An additional object of the instant invention is to provide for displacement of a broken plug segment and eliminating the need to remove/replace a jack housing accommodation.

A better understanding of the invention and its objects and its advantages will become apparent to those skilled in this art from the following detailed description taken in conjunction with the attached figures wherein there is shown and described only the preferred embodiment of the invention simply by way of illustration of the best mode contemplated for carrying out the invention. As will be realized, the invention is capable of modifications and various obvious respects all without departing from the invention. Accordingly, the description should be regarded as illustrative in nature and not as restrictive.

DETAILED DESCRIPTION OF THE PREFERRED EMBODIMENTS

The preferred embodiment of the present invention generally relates to an electrical jack and more specifically, to an electrical jack assembly comprising a plurality of compressible cylindrical contacts which receive and securely position an electrical plug thereby, to facilitate an electrical connection between distinct contact portions of the plug and electrical circuitry in communication with said contacts.

Figure 1:
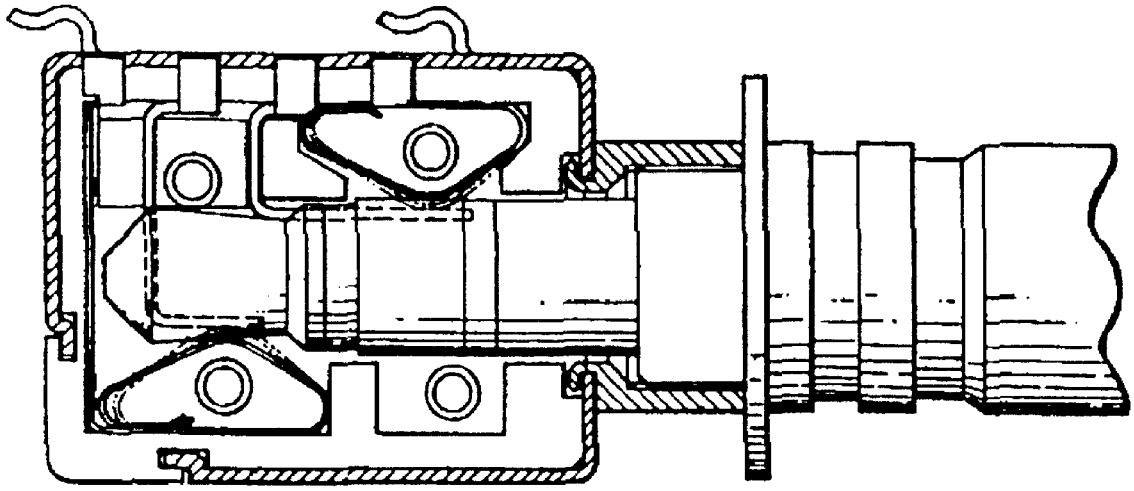
FIG. 1 PRIOR ART
FIG. 1 is an illustration of a typical electrical plug/jack combination as found in the prior art.
Figure 2:
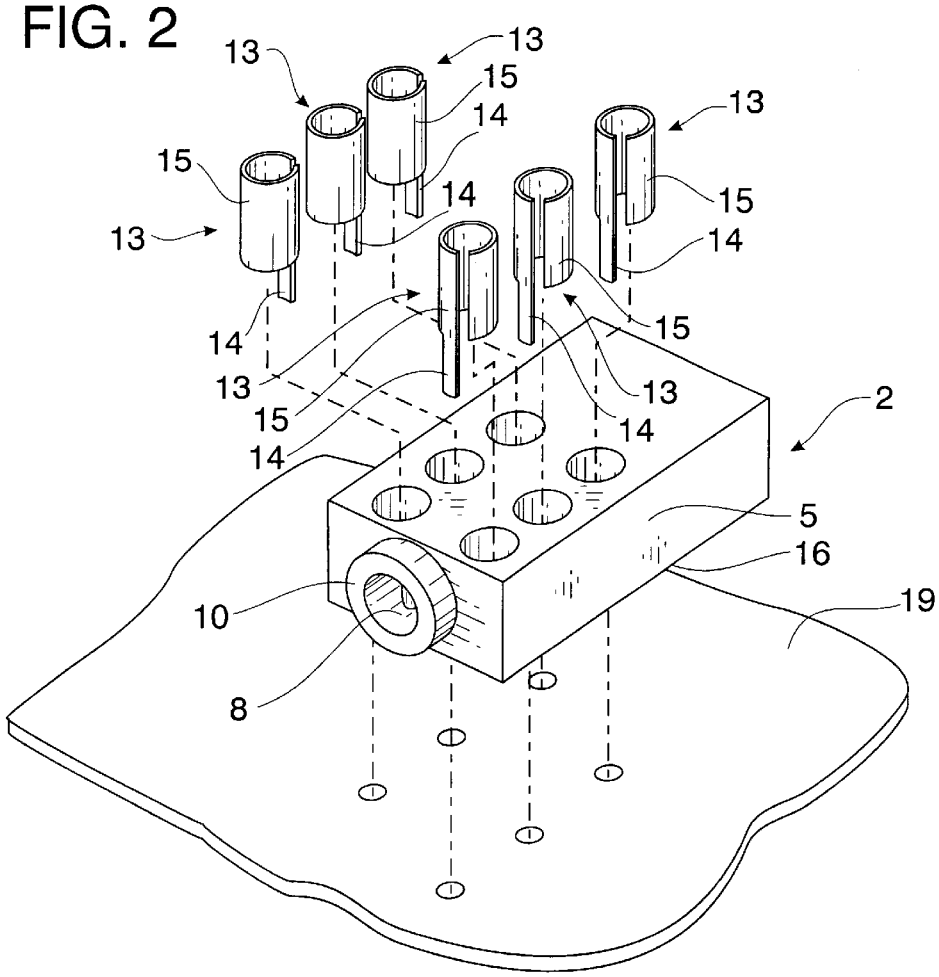
FIG. 2 is an exploded view of the invention's components when practiced in its preferred embodiment.

FIG. 2 provides an illustrative diagram of the invention's internal and external components when practiced in its preferred embodiment. As shown in FIG. 2, an electrical jack 2 is comprised of a housing 5 which further embodies a plurality of compressible, partially cylindrical contacts 13 for slidably receiving an electrical plug, the plug having distinct electrical contact portions. An electrical plug, commonly known to those skilled in the art, is inserted into the invention's electrical plug receiving chamber 8 via an access/egress aperture 10 attached or embodied within the jack housing 5 and in communication with said receiving chamber 8.

The contacts 13 of the instant invention each have a circuit contact section 14 and an electrical plug contact section 15. Said contacts 13 are housed within said chamber 8 and are positioned generally perpendicular to the base 16 of said jack, along generally opposite sides of the chamber. Each contact 13, has what is generally regarded as an electrical plug contact section 15, which in the inventions preferred embodiment is represented as a compressible cylindrical cylinder-like structure allowing for compression of electrical plug contact section 15 when an electrical plug is inserted into the chamber 8, or a decompression or expansion of the cylinder 15 when the electrical plug is removed. Said expanding and compression of said electrical plug contacts section 15 allowing for the acceptance, positioning and securing of an electrical plug in a manner superior to that provided by present art structures.

Continuing with FIG. 2, the contacts 13 further embody what is regarded as a circuit contact section 14 which extend beyond the receiving chamber 8 into and through a circuit board 19 allowing contact with a printed, or otherwise affixed circuit, typically located on the underside of the circuit board 19.

Figure 3:
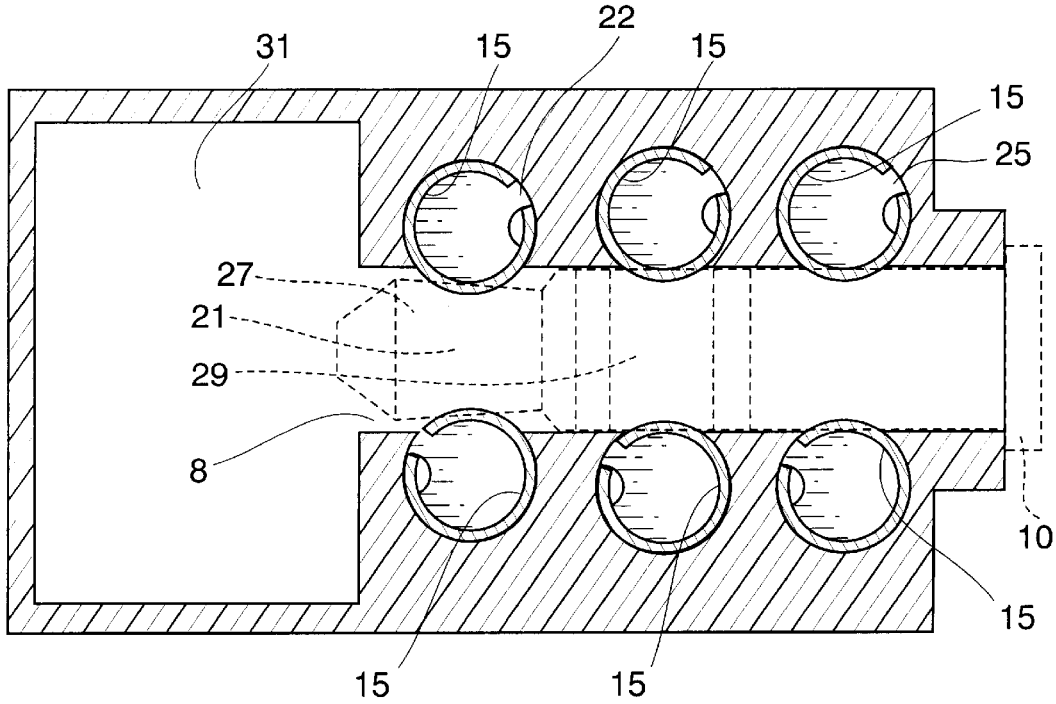
FIG. 3 is a top perspective cross sectional view of the invention as practiced in its preferred embodiment with an inserted plug in phantom.

As can be easily appreciated, the present invention can be sized to accommodate electrical plugs of varying dimension. In the invention's preferred embodiment, extensive testing has indicated that the invention's contacts 13 are most effectively deployed for positioning and secring an electrical plug when comprised of a beryllium copper and nickel plating composition and tensioned to require a withdrawal force between 15 to 20 grams to remove the plug. FIG. 3 illustrates the invention as practiced in its preferred embodiment with an electric plug 21 inserted. Turning now to FIG. 3.

In FIG. 3, an electrical plug 21 has been inserted within the invention's electrical plug receiving chamber 8. FIG. 3, also illustrates the variable compression of contacts 15, indicative and illustrative of the compression/expansion potential of all such contacts, once said contacts 15 have come in contact with said plug 21. As electrical plugs of the existing art, typically comprise two distinct electrical contact areas 27 and 29, the invention is structured such to allow independant communication of said areas 27 and 29 with appropriately located points of electrical circuitry imprinted or otherwise affixed to an electrical circuit board (not shown).

As can also be observed in FIG. 3 is the invention's plug tip reservoir 31. In the event a portion of a previously inserted plug should break, or otherwise become dislodged within the receiving chamber 8, the invention provides a significant advancement over the art by allowing a new plug to be inserted into the chamber 8 and pushing the dislodged portion of the previously inserted plug into the invention's reservoir 31. Such dislodging allowing for continued use of the jack will eliminate or defer the necessity of jack replacement. In an alternative embodiment, it is easily envisioned where the invention's reservoir 31 could be eliminated or a reservoir of diminished depth could be employed in conjunction with an exiting aperture 8 to allow for the "pushing through" of a dislodged plug portion, through said reservoir and exiting via said aperture.

As earlier discussed in FIG. 2, such contact is facilitated via the electrical plug contact section 15 and circuit contact section (not shown) of the invention's electrical contacts 13. The flexibility and adaptability of the invention allows for one or more contacts 13, to facilitate such communication with electrical circuitry, though one distinct contact for each area of the plug has worked satisfactorily. Contact sections 15 not in communication with electrical circuitry are practiced in the invention's preferred embodiment so as to provide for enhance positioning and securing capabilities.

While the foregoing detailed description has described several embodiments of the sheave seal design in accordance with this invention, it is to be understood that the above description is illustrative only and not limiting of the disclosed invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An electrical jack for receiving an electrical plug having a body portion and a tip portion to establish an electrical connection therebetween, said jack comprising:

a one piece housing having an electrical plug receiving chamber, an access/egress aperture, said aperture communicating with the chamber for insertion therethrough of an electrical plug;

a plurality of compressible cylindrical plug contacts positioned perpendicularly to a base of said jack with each contact having a circuit contact section and an electrical plug contact section; and a generally rectangular plug tip reservoir accommodated within the interior portion of said housing, said reservoir having an entrance larger than the diameter of an electrical plug introduced thereto and dimensioned to accommodate at least one entire electrical contact section of a first inserted electrical plug whenever the positioning of a second inserted electrical plug between said plurality of compressible cylindrical contacts is required.

2. The jack of claim 1, wherein said reservoir is of approximately three-eights inch by one-half inch by three-sixteenths inch dimension.

3. The jack of claim 1, wherein said plurality of compressible contacts are positioned along generally opposite sides of said chamber.

4. The jack of claim 1, wherein at least two of said circuit contact sections exit said chamber and further extend through a circuit board effectuating an electrical connection between an electrical circuit in communication with said board and said plug.

5. The jack of claim 1, wherein said one piece housing further comprises:

a top surface, a bottom surface, first, second, third and fourth sides with said first and second sides positioned generally parallel to one another and along a plane substantially perpendicular to said third and fourth sides.

6. The jack of claim 1, wherein said housing further comprises an exiting aperture, said aperture to allow for the traversing and exiting of a portion of a previously inserted electrical plug.

7. The jack of claim 1, being further defined as designed for use with an aircraft.

8. The jack of claim 1, being further defined as designed for use with a personal entertainment system.

9. The jack of claim 1, being further defined as designed for use with a communications system.

10. The jack of claim 1, being further defined as designed for use with an electrical amplification system.

11. The electrical jack of claim 1 wherein said one piece housing is a molded one piece housing.

12. An electrical jack for receiving an electrical plug having a body portion and a tip portion, to establish an electrical connection therebetween, said jack comprising:

a one piece housing having an electrical plug receiving chamber and an access/egress aperture, said aperture communicating with the chamber for insertion therethrough of said electrical plug;

six compressible cylindrical contacts each having a circuit contact section and an electrical plug contact section housed within said chamber and positioned perpendicularly to a base of said jack along opposite sides of said receiving chamber; and a generally rectangular plug tip reservoir accommodated within the interior portion of said housing, said reservoir having an entrance larger than the diameter of an electrical plug introduced thereto and dimensioned to accommodate at least one entire electrical contact section of a first inserted electrical plug whenever the positioning of a second inserted electrical plug between said plurality of compressible cylindrical contacts is required.

13. The jack of claim 12 wherein each of said circuit contact sections exits said chamber with said exiting extending each said contact section through a circuit board.

14. The jack of claim 12 wherein at least two of said circuit contact sections exit said chamber and further extend through a circuit board effectuating an electrical connection between an electrical circuit in communication with said board and said plug.

15. The jack of claim 12 wherein said housing further comprises:

a top surface, a bottom surface, first, second, third and fourth side surfaces with said first and second side surfaces positioned generally parallel to one another and along a plane substantially perpendicular to said third and fourth sides.

16. The jack of claim 12 wherein said housing further comprises an exiting aperture, said aperture allowing for the traversing and exiting of a portion of a previously inserted electrical plug.

17. The jack of claim 12 being further defined as designed for use with an aircraft.

18. The jack of claim 12 being further defined as designed for use with a personal entertainment system.

19. The jack of claim 12 being further defined as designed for use with a communications system.

20. The jack of claim 12 being further defined as designed for use with an electrical amplification system.

21. The electrical jack of claim 12 wherein said one piece housing is a molded one piece housing.

* * * * *